United States Patent [19]

Higgs

[11] 4,017,924

[45] Apr. 19, 1977

[54] LIFE SAVING EQUIPMENT FOR VESSELS

[75] Inventor: William York Higgs, Gibsons, Canada

[73] Assignee: Intercontinental Marine Limited, Vancouver, Canada

[22] Filed: Dec. 15, 1975

[21] Appl. No.: 640,787

Related U.S. Application Data

[62] Division of Ser. No. 471,964, May 21, 1974, abandoned.

[30] Foreign Application Priority Data

May 21, 1973 United Kingdom ..... 24113/73

[52] U.S. Cl. ..... 9/14; 9/3; 9/11 R; 9/30

[51] Int. Cl.[2] ..... B63C 9/02

[58] Field of Search ..... 9/1 A, 14, 11 R, 11 A, 9/4 R, 4 A, 3, 30, 1.3

[56] References Cited

UNITED STATES PATENTS

| | | | |
|---|---|---|---|
| 208,575 | 10/1878 | Dickenson | 9/4 R |
| 1,276,055 | 8/1918 | Groleau | 9/30 |
| 1,377,486 | 5/1921 | Johnson | 9/4 R |
| 2,417,508 | 3/1947 | Leyde | 9/3 |
| 2,844,120 | 7/1958 | Nelson | 9/1 A X |
| 2,968,820 | 1/1961 | Pritty | 9/11 R |

*Primary Examiner*—Stephen G. Kunin
*Assistant Examiner*—Sherman D. Basinger
*Attorney, Agent, or Firm*—Stevens, Davis, Miller & Mosher

[57] ABSTRACT

Lifesaving apparatus for vessels in the form of a buoy releasably carried by a vessel in a manner so as to float free if the vessel sinks while remaining attached to the vessel by a cable held on a reel on the buoy and having its outer end connected to the vessel. The buoy includes a deck area suitable for accommodating crew members and passengers, and life raft canisters carried on the deck, the canisters containing sources of pressurized gas, so that crew members can readily remove the canisters one by one from the deck area, place these in the water, and inflate the life rafts bursting open the canisters. The deck area of the buoy acts as a loading platform which receives passengers from the sinking vessel and facilitates loading of the passengers onto the rafts which in turn are held connected to the life boat mooring line forming part of this buoy thereby preventing scattering of survivors. In addition to the life saving function, the apparatus of this invention also is useful in preventing pollution, wreck marking, marine salvage and fire fighting.

18 Claims, 6 Drawing Figures

LIFE SAVING EQUIPMENT FOR VESSELS

The present application is a divisional of U.S. patent application Ser. No. 471,964, filed May 21, 1974, now abandoned and superseded by continuation-in-part application Ser. No. 649,788 filed Jan. 16, 1976.

This invention relates to lifesaving apparatus for vessels, and particularly to improvements in the inventions described in our Canadian Pat. Nos. 849,286 (dated Aug. 18, 1970) and 964,126 (dated Mar. 11, 1975). These inventions are concerned with a buoy which is suitable for being carried by a vessel in a manner permitting release and floatation of the buoy should the vessel sink, said buoy including a body having sufficient buoyancy to cause the buoy and parts carried thereby to float free from the sinking vessel, a normally stowed cable of adequate strength to act as an anchor cable, the cable being connected with the buoy and for connection with the vessel so as to maintain connection between the floating buoy and the vessel after this has sunk.

The buoys described in the aforesaid patents include both light and radio beacons which automatically give distress signals when the buoy is floating in the water. Also, a particular feature of the Canadian Pat. No. 849,286 was the use of a buoyant life boat mooring line which is relatively long compared to the dimensions of the buoy and which is normally stowed on the buoy, but which is released automatically when the buoy separates from the vessel to stream out on the water and to provide mooring means for buoyant equipment such as life boats, life rafts, etc. released from the vessel. The buoyant equipment held in this way remains in marshalled condition in the vicinity of the sunken vessel and can easily be located by the beacons described, and this arrangement provides the further advantage that the buoyant equipment stays head-on to the wind and sea so that the risk of upset is minimized.

The buoys described in the aforesaid patents rely primarily for their lifesaving capability on the presence of buoyant equipment such as life boats and life rafts which would be released form the vessel before this sinks, although the buoy does provide hand loops which can be grasped by swimmers in the water, who can also hold onto the life boat mooring line. The buoy described in co-pending application Ser. No. 471,964 has additional lifesaving capabilities in that it also carries inflatable life raft means which are quite independent of any buoyant equipment normally carried by the vessel, and which can support crew members or passengers even if for one reason or another the life boats or life rafts normally held by the vessel cannot be launched or cannot be properly utilized.

The present invention also provides a buoy carrying life raft means, and is concerned with a buoy especially suitable for use on large vessels having hundreds, or thousands, of passengers.

Life saving apparatus in accordance with this invention comprises a buoy suitable for being carried by a vessel in a manner permitting easy launching of the buoy should the vessel sink. The buoy has a buoyant body and includes a deck area for accommodating crew members and passengers, and also carrying a plurality of life rafts in canisters releasably held on the buoy. The buoy includes a mooring line normally stowed on a reel carried by the buoy but releasable therefrom after the buoy has been released from the vessel, the mooring line being capable of holding the life rafts in position relative to the buoy. The life rafts preferably have a carrying capacity much greater than the deck of the buoy, and the deck serves primarily as a loading platform, receiving passengers from the sinking ship and permitting easy loading of the passengers into the life rafts, as these are inflated and held in position by crew members.

The life raft in accordance with this invention may have a cable reel rotatably mounted on the buoy and carrying a cable of adequate strength to act as an anchoring cable, the cable being suitable for connection with the vessel to maintain connection between the buoy and the vessel when the vessel has sunk and thereby to prevent undesirable drifting of the buoy and the life rafts moored thereto. Alternatively, or additionally, the life raft may be self-propelled by its own engine and propeller. The buoy will of course carry radio and light beacon means.

A preferred form of buoy of this kind is large enough to itself carry 25 persons, and carries enough inflatable life rafts to accommodate several hundred persons. In addition to the lifesaving features of the buoys described in my prior patent and application aforesaid, this buoy may also have its own electrical generator, and food and medical supplies stored in a deck house, and water pumped from a tank below deck.

The invention will be more particularly described by way of example with reference to the accompanying drawings, in which.

Figure 1:
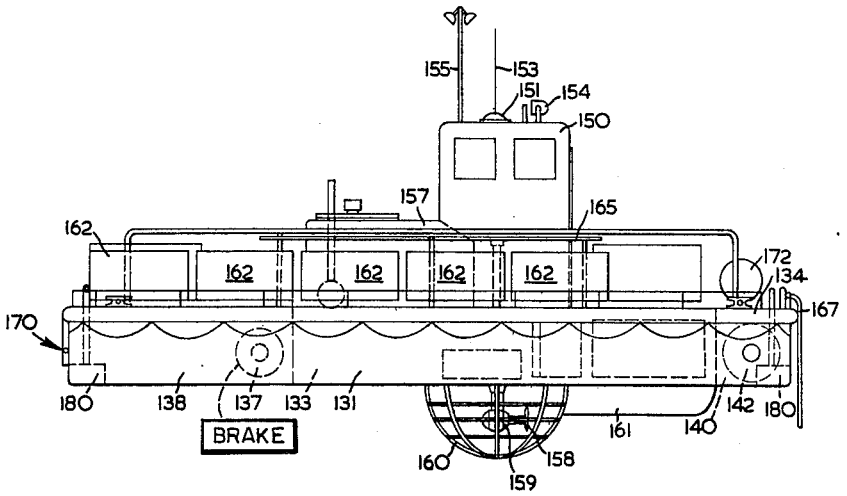
FIG. 1 shows an elevation of a buoy in accordance with this invention.

The buoy shown in the drawings is intended to be carried by large ocean going liners, the crew and passengers of which together may number several hundreds or several thousand, although the buoy may also be made in smaller sizes suitable for a wide range of ships such as coastal and lake passenger vessels, rail ferries, excusion and cruise ships, and cargo and military vessels. A main purpose for this buoy is to provide buoyant equipment, i.e. multiple inflatable life rafts, to compensate for the loss of life boats and other buoyant equipment which so often become damaged or cannot be launched from the high side of a vessel in distress and sinking. A case in point was the loss of the "Andrea Doria" outside New York Harbour. None of the life boats on her high side were launched although she took several hours to go down. It was fortunate in her case that the sea was comparatively smooth and that the ships which were close by were able to use their life boats in the rescue of survivors. The sinking of the "Titanic" provides another instance where buoys of the type shown in FIGS. 1 to 3 could have been used to save many or all of those killed. Hundreds of similar sinkings, strandings and fires with heavy loss of life within the inventor's span of working life since the Titanic was lost would certainly have reduced their regrettable heavy death toll had such a buoy been in use in addition to all other buoyant lifesaving equipment.

Large vessels such as liners rarely sink quickly, in view of the manner in which their hull is divided into many compartments with closeable water-tight doors. Therefore, although it is most desirable that the buoy shall still be so mounted on the ship that it can float clear in the event of a sudden sinking, it is proposed that means shall be provided for launching the buoy over either side of the ship, while the buoy still remains connected to the ship by its anchoring cable, so that the passengers and crew can be embarked into life rafts in an orderly manner and can get clear of the ship with the buoy before the ship sinks. The sinking of a large ship causes considerable turbulence so that it is important that the life boats and life rafts etc. get clear before the actual sinking takes place.

The buoy shown in FIGS. 1 to 3 comprises a hull or casing 131 formed of glass fiber reinforced plastics or sheet metal carried by a suitable frame and filled with foamed plastics materials 133 of closed pore type, except in the region of certain compartments mentioned below. For example, Styrofoam (Trademark) is a suitable filling. This buoyant material should preferably be sufficient to support the whole weight of the buoy, including the inflatable life rafts and other equipment carried thereby, and including as many passengers and crew as can stand upon the deck area, without placing any reliance on water-tight hollow compartments which may become subject to leakage. An upper part of the hull is encircled by a guard 134 preferably of soft rubber, i.e. a material having a firm outer coverging but internally consisting of a foamed rubber of the closed pore type.

Figure 2:
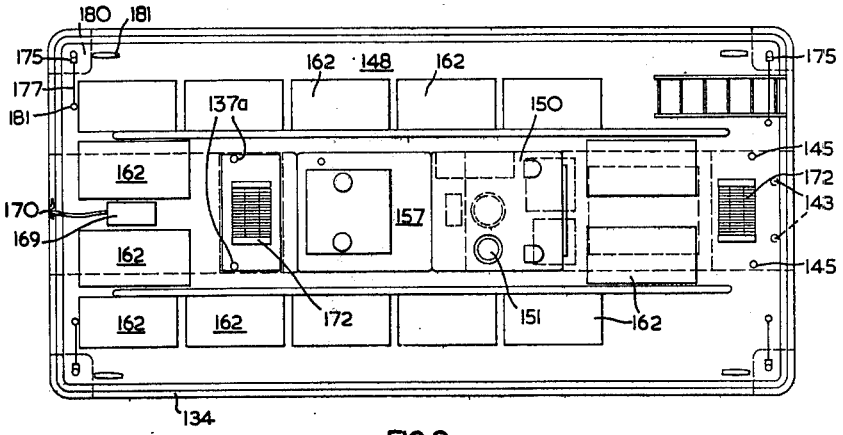
FIG. 2 shows a plan view of the buoy.
Figure 3:
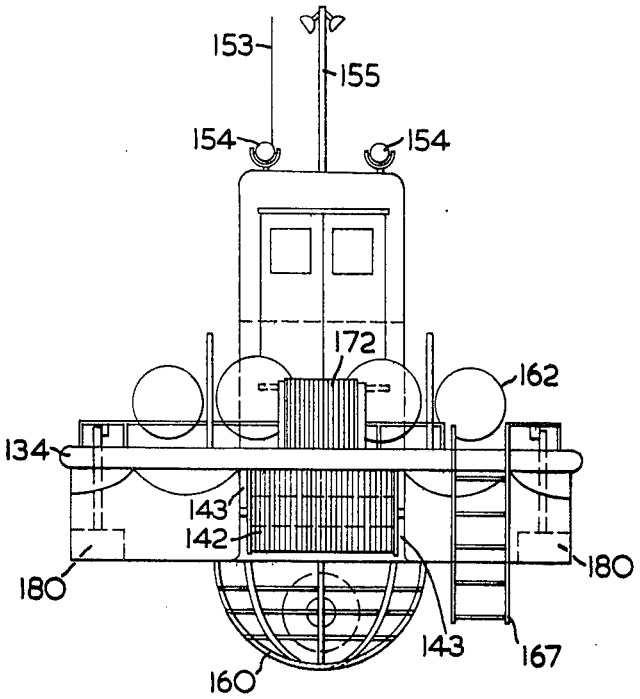
FIG. 3 shows a rear view of the buoy.

A typical size for the buoy shown in FIGS. 1 to 3 would be a length of 26 feet, a width of 12 feet, and a depth of 2 feet 9 inches, but the size will vary in accordance with the class of vessel on which it is utilized.

Figure 4:
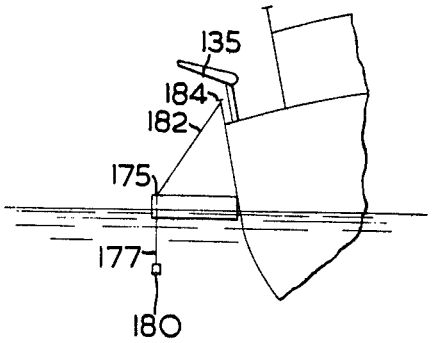
FIG. 4 shows, diagrammatically, the buoy in position alongside the vessel during disembarkation of passengers from the vessel.

On passenger carrying ferries and other ships which have large clear deck areas the buoy shown may be stowed on an elevated slanting railway type steel traveller which can usually run about 7 feet above the ship's deck from one side to the other so that if one buoy is carried it may be easily launched from either side. However, many ships will carry two or more such buoys, and these are preferably stowed on the same set of rails and can also be launched from either side. The launching is preferably performed with a boom 135 as shown in FIG. 4. However, the buoy is preferably lashed in position on the traveller in such manner as to break itself free in the event of a sudden sinking.

Figure 5:
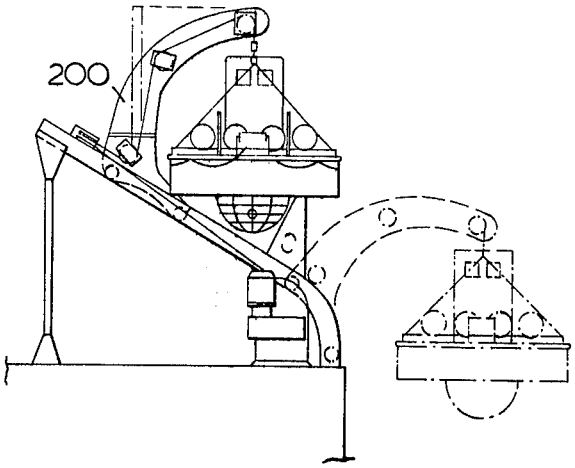
FIGS. 5 and 6 are two views of stowing and launching means for the buoy shown in FIG. 1.
Figure 6:
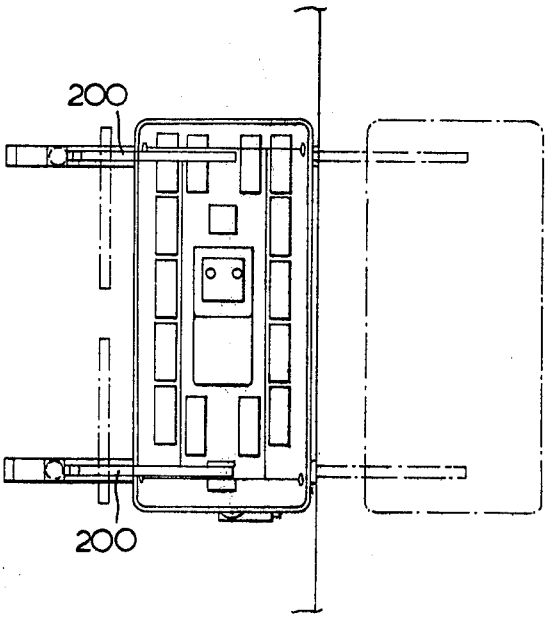

Other types of high passenger and crew carrying capacity ships such as the "Queen Elizabeth II" and many ships designed for cruises may have over three thousand people on board. Such vessels have continuous and high deckhouses which would not be suitable for installation of the combination railway-traveller mount for the buoys for launching on either side of the ship. In this case four such buoys may be carried at fore and after quarters of the boat deck, port and starboard but with stowing and launching arrangements as shown in FIGS. 5 and 6. One such arrangement may be incorporated right at the stern in most of these large vessels to great advantage.

In the arrangement shown in FIGS. 5 and 6, two gravity davits 200 are used, each of which can support one end of the buoy for moving the buoy from the stowed position shown in full lines in FIG. 5 to a launching position shown in broken lines. These davits are generally similar to standard life boat davits, but are modified in that they can be swung about a vertical axis to a stowed position (shown in broken lines in FIG. 6) in which they are clear of the buoy. This allows the buoy to float free from the stowed position in the event of sudden sinking, the buoy being held in the stowed position by breakable lashings or other automatically releasing means to allow such automatic launching to occur.

In this embodiment of the buoy, the cable reel 137 is mounted in a compartment 138 which has an open bottom, this compartment being positioned in a central area of the buoy but somewhat offset towards the front end to ensure that in a wind or current the buoy will assume a stable orientation when it is restrained by the anchoring cable extending down from the reel 137 to the sunken ship. This anchoring cable will be about 5000 feet in length, and will be 5/16 inch diameter galvanized steel wire cable. A foot operated brake (see FIG. 1), controllable by a foot pedal 137A by a crew member, permits controlled paying out of the cable. In deep sea operation, should it be forgotten to release the cable from the ship or if there is not time to do so, the reserve buoyancy of the fully loaded buoy, which is over three times the strength of the anchoring cable, will cause the cable to break. The cable will however hold the buoy in place until all the cable has been paid out from the reel At the stern or down wind end of the buoy, a compartment 140, open at the stern end of the buoy, is provided in which is housed a second reel 142 carrying 5000 feet of buoyant polypropylene lifeboat mooring line of 1 inch diameter with eyes provided every 75 feet to which life rafts, life boats etc. may be moored. The line has floats along its length for easy visibility, and carries at its outer end a water activated light containing a silver-magnesium battery, and giving a steady white light visible for about 3 miles. Vertical rollers 143 at each side of recess 140 prevent chafing of the mooring line on the reel flanges. The paying out of the line from reel 142 is controlled by operation of either of two foot brake release pedals 145, one at each side of the reel, suitable for operation by a crew member standing on the deck.

The top of the buoy is substantially flat to provide a working deck 148, and centrally on this deck is provided a shelter or deck house 150 which carries on its roof a clear Lucite (Trademark) dome 151 containing a strobe light, and the roof also carries an antenna 153, these providing light and radio beacon means similar to those described with reference to the first embodiment. However, as well as a simple homing beacon transmitter, a transceiver is also provided, which can be operated by a crew member in the deck house. The deck house roof also carries a mast 155 which carries a radar reflector and floodlights, and which is hinged at its lower end so that when not in use it can be lowered onto the deck house roof. Two searchlights 154 are also installed on the deckhouse roof.

Although buoys of this type may be unpowered, the buoy preferably has an engine compartment 157 housing an 83 horsepower 3 cylinder diesel engine, supplied by fuel tanks under the deck. This engine drives a propeller 158 mounted centrally below the bottom of the buoy, and carried on a mounting 159 rotatable about a vertical axis so that a 360° drive is provided. This type of drive arrangement is rather similar to that used on boom boats. The propeller is thoroughly screened by a screen 160 so that no ropes or survivors can be caught by the propeller. Aft of the screen 160 is a small keel or skeg 161 for directional stability. This drive arrangement gives very easy and rapid maneuverability for the buoy in all directions. The engine which drives the propeller 158 also operates two alternators to supply power through two sets of storage batteries to the floodlights carried by the mast and which may also supply power for further lights and for the radio transmitter and heating. The electrical system will be completely duplicated for safety. In order to ensure suitable starting of the engine under adverse conditions, the engine compartment 157 is preferably continuously heated by the ship's power when the buoy is on the ship's deck, and by the engine itself when the buoy has been released from the ship. This heating arrangement will serve as a de-icing system while ships carrying these buoys are operating under Arctic conditions.

Distributed over the deck 148 are 14 inflatable life rafts 162, lashed down on curved rubber chocks by adjustable webbing and pelican hooks attached to cleats suitably recessed into the deck 148 so that when the life rafts are launched and survivors are being loaded into these, the deck is free from dangerous foot-catching projections. Each of the inflatable life rafts is capable of carrying 25 or 32 persons, although on emergency overload this number can be increased by 50 percent. Thus, with 25 man life rafts, those carried by this buoy would normally accommodate 350 persons, although with the emergency overload, and up to 50 persons accommodated on the buoy itself, a total of 575 persons could be rescued by this one buoy. In this case, the life rafts have a capacity at least seven times that of the buoy. If 32 man life rafts are used, the total emergency capacity of the buoy and life rafts would be 797 persons.

Each of the life rafts 162 is contained in a generally cylindrical canister having two separable hollow parts normally sealed together by a rupturable seal. The canister is provided with release means in the form of a combination pull cable and raft painter connected near its inner end to valve means which releases gas from a stored cylinder of compressed carbon dioxide into the life raft to inflate this so that it bursts the container apart. When it is desired to inflate a life raft the canister is removed from the deck and dropped over the side of the buoy to float along side the buoy in the water. A crew member secures the pull cable painter to a mooring rail on the buoy then fully pulls the remaining painter from the canister, which, in turn, actuates the short tripping cable to the gas valve. In one minute the raft is ready to be loaded. The painter of the raft is then tied to an eye on the long life boat mooring line while another crew member is repeating this procedure. After attachment of each raft, one of the foot pedals 145 is operated to allow enough of the mooring line to unwind from reel 142 to reveal another eye on the line.

The deck is provided with two hand rails, and may incorporate features such as boat hooks 165 for use by the crew in assisting swimmers to a hinged mooring ladder 167 at the stern of the buoy which can be raised from the lowered operative position shown to lie on the deck of the buoy. The buoy body is recessed under the deck house 150 to receive a fresh water tank, and a tank for calming oil released by a valve in the deck house and fuel tanks. Another important feature of the buoy is a sea anchor which is stowed together with its 300 feet of line in a locker 169 near the front of the buoy, line terminating in a wire rope pennant having its end attached to an eye 170 low on the bow of the buoy.

Reels 172 are provided fore and aft of the buoy for the stowing of working, mooring and general utility ropes. These are used by the crew to assist in the positioning of the buoy relative to the vessel during loading and disembarkation of passengers therefrom. The positioning of the buoy (particularly if unpowered) relative to the vessel is also assisted by a counter weight arrangement shown in operation in FIG. 4. At each side of the buoy there are provided two pulleys or circular ferrules 175, adjacent opposite ends of the buoy, i.e. one pulley or ferrule in each corner. Each pulley or ferrule carries a tag line 177, with toggles and an eye at its upper end where it is releaseably secured to a cleat 181 on the deck 148. The lower end of each line carries a lead counter weight 180 which is normally stowed in a recess provided one at each lower corner of the buoy. FIG. 4 indicates how these counter weights can be used if the buoy is launched over the side of the ship to provide a temporary holding and stabilizing force on the buoy. This action is ancillary to that of the usual spring and brest securing lines on the buoy operated by hand and secured to cleats 181 and stowed on reels. It will be seen that two of the counter weights 180 are brought into action at that side of the buoy remote from the ship, by releasing the toggle at the upper end of the tag line from the cleat 181 on the deck, and then lowering the counter weight on the tag line until in a position as shown. A temporary restraining line 182 secured to any convenient stanchion 184, cleat or railing on the ship, is connected to the upper end of the tag line 177, and the resulting tension on the securing line and the tag line caused by the force of gravity on the two weights 180 provides a force holding the buoy in a steady but yielding manner against the side of the ship until it is desired to cast off the securing lines, and also the spring and brest lines to permit the buoy to drift or navigate away down-weather from the ship before this sinks. The working lines are used to position the buoy longitudinally of the ship. The powered buoys will effectively position themselves and hold that position at any location on the ship's side.

The manner of use of the buoy may be dictated largely by the circumstances at the time of shipwreck. The buoy will be launched on the lee side of the ship either by the boom 135 shown in FIG. 4 or by the davit arrangement shown in FIGS. 5 and 6, with the cable reel 137 at the down wind end of the buoy, the cable on this reel normally remaining attached to the ship. However, in cases where the ship is traversing a depth of greater than 5000 feet, the cable is disconnected from the ship as standard procedure. The buoy will be positioned by the brest and spring lines wound on reels 172, and also by the counter weight, tag line and tether arrangement described with reference to FIG. 4. Then, trained members of the crew can take the life rafts one at a time, launch and inflate these, and then tether them to the eyes on the mooring line at spaced intervals as this line is paid out from the reel 142. Preferably, the life rafts are filled with passengers as soon as they are inflated, and then are allowed to stream out down wind from the buoy on the mooring line. Survivors in the water can swim to the buoy or the rafts and board them. Also, the ship's life boats, which tend to fill beyond capacity owing to certain life boats being unlaunchable, can transfer their excess passengers to these rafts, and can then secure themselves to the life boat mooring line.

In the case of a sudden sinking, crew members can swim to the buoy, and proceed to inflate and launch the life rafts as described above as survivors swim to or are ferried to the buoy.

The buoy would be particularly useful because not only does it provide a large supply of sure and instant buoyant equipment but also supplies a flood lighted stable platform to facilitate the rapid and sure evacuation of passengers and ship's company. Confusion, slanted decks and darkness coupled with power failure are some of the reasons that so much buoyant equipment never gets away from the ship with resultant heavy death toll. In the event of fire at sea the buoy would be especially useful on account of its rapid launching characteristics and maneuverability.

If disconnecting from the ship, (in circumstances where the depth is greater than the 5000 feet of buoy anchoring cable) then securing lines are taken in and the sea anchor or drogue held in container 169 is cast overboard with its line remaining permanently attached to towing eye 170 on the buoy. The two forward counter weights 180 are lowered to the full length of their tag lines. The effect of the lowered weights combined with the positive action of a large sea anchor or drogue both keep the unpowered buoy head up to the weather and seas, and also hold in the same manner buoyant lifesaving equipment attached to the mooring line. The engined buoy may be operated to keep its own head to weather with buoyant equipment in the same condition, minimizing danger of upset.

It will be appreciated that the buoy preferably is provided with a variety of stores in the form of life saving equipment, flares, medical stores, food and water and food heating means preferably stored within deck house 150. Another useful piece of equipment normally carried would be a heavy tarpaulin which is permanently affixed to the head end of the buoy. This tarpaulin may be hauled back, secured to the deck house 150 and lashed at the sides of the buoy to protect survivors who remain on the buoy. Alternatively, prefitted tarpaulins and lashings may be carried in deck house 150.

The self-propelled feature of this buoy is optional, and a very useful, generally similar buoy could be made without propulsion means, although in large ships at least two powered buoys should be carried as well as those which are unpowered.

In these days of efficient radio, survivors protected in the overall manner described above would be rescued in the minimum of time. If allowed to run free in boats, life rafts and other buoyant equipment even with a radio in each unit, the proportion of those rescued is distressingly low.

Although the buoys just described are of simple rectangular shape for economy, similar buoys may well be made with shaped and raised bows.

The inventor does not recommend that buoyant lifesaving equipment now carried by ships be reduced by reason of the installation of any models of the buoys he has invented. These buoys should be in addition to all lifesaving equipment now in vogue. It has been his experience during over 50 years of life closely associated with the sea, that in sinkings by any cause at sea there is invariably insufficient buoyant lifesaving equipment available from one cause or another.

In addition to the life-saving capabilities, the buoys described above also assist in the following functions:

1. Preventing pollution for example from oil tankers by giving immediately the location of a sinking vessel.

2. Instant wreck marking, thus ensuring that there is no collision between a surface vessel and a sunken vessel. This has frequently occurred in crowded waters. Also, fast and accurate installation of permanent wreck markers is facilitated.

3. Marine salvage. The buoys operate as mooring points for salvage vessels, and the anchoring cable serves as a "shot line" for divers. The buoy shown in FIGS. 1 to 3 is particularly valuable for this service since it provides a good working deck with floodlighting and electrical and food and water supplies, and can support perhaps 20 tons of salvage equipment.

4. Fire fighting. The buoy may be equipped with fire fighting equipment usable against ship fires.

I claim:

1. Lifesaving apparatus for vessels comprising a buoy suitable for being carried by a vessel in a manner permitting easy launching of the buoy should the vessel sink, said buoy including a buoyant body and a cable reel rotatably mounted on the buoy and carrying a cable of adequate strength to act as an anchor cable, said cable being suitable for connection with the vessel so as to maintain connection between the floating buoy and the vessel after the vessel has sunk, wherein said buoy includes a deck area suitable for accommodating at least one crew member and several passengers and having a configuration which provides a stable loading deck to receive passengers from the vessel and to allow the passengers to enter life rafts held close to the buoy, and also accommodates a plurality of inflatable life rafts together with pressurized gas containers for inflating the rafts said rafts having a combined capacity greatly in excess of the number of persons that can be carried on the buoy itself, said rafts being contained in canisters releasably held on said deck, said buoy including a mooring line normally stowed on a reel carried by the buoy but releasable therefrom under the control of a crew member after the buoy has been released from the vessel, said mooring line being capable of holding said plurality of life rafts when inflated and floating on the water and when carrying passengers.

2. Lifesaving apparatus according to claim 1, wherein said reel carrying the anchoring cable is provided with a brake arranged to be operated by a crew member on the deck of the buoy.

3. Lifesaving apparatus according to claim 1, wherein said buoy has a substantially flat bottom and is provided with an engine drivingly connected to a propeller situated in a generally central position under the buoy, said propeller being mounted on a spindle which is carried by a mounting rotatable about a vertical axis to direct the propeller in different directions relative to the buoy.

4. Lifesaving apparatus for vessels comprising a buoy suitable for being easily launched should the vessel sink, said buoy including a buoyant body and having a substantially flat bottom, and being provided with an engine drivingly connected to a propeller situated in a central position under said body, said propeller being carried by a shaft held by a mounting which is rotatable about a vertical axis to direct the propeller in different directions relative to the buoy, said buoy including a deck area suitable for accommodating at least one crew member and several passengers and having a configuration which provides a stable loading deck to receive passengers from the vessel and to allow the passengers to enter life rafts held close to the buoy, and also carrying a plurality of inflatable life rafts which together with pressurized gas containers for inflating the rafts are contained in canisters releasably held on said deck area, said life rafts having a combined capacity greatly in excess of the numbers of persons that can be carried by the buoy itself, said buoy also including a mooring line normally stowed on a reel carried by the buoy but releasable therefrom under the control of a crew member after the buoy has been released from the vessel, said mooring line being capable of holding said plurality of life rafts when inflated and floating on the water and when carrying passengers.

5. Lifesaving apparatus in accordance with claim 1, containing sufficient buoyant material to support the whole weight of the buoy and parts carried thereby with reserve buoyancy for personnel, without reliance on any water-tight compartments.

6. Lifesaving apparatus according to claim 1, wherein said buoyant body is substantially filled with closed pore foam plastics.

7. Lifesaving apparatus as claimed in claim 1, in combination with mounting means arranged to be carried by a vessel above the deck thereof and allowing the buoy to be launched from either side of the vessel, said mounting means including means for suspending the buoy during launching, which means are displaceable so as to allow the buoy to float off the vessel without entanglement in the event of a sudden sinking.

8. Lifesaving apparatus according to claim 1, wherein said mooring line is buoyant and carries a light and eyes spaced along its length.

9. Lifesaving apparatus according to claim 1, wherein said life rafts have a capacity at least seven times that of the buoy.

10. Lifesaving apparatus according to claim 4, wherein said life rafts have a capacity at least seven times that of the buoy.

11. Lifesaving apparatus for vessels, comprising a buoy suitable for being carried by a vessel in a manner permitting easy launching of the buoy should the vessel sink, said buoy including a buoyant body with a deck area suitable for accommodating crew members and several passengers, and having a configuration which provides a stable loading deck to receive passengers from the vessel and to allow the passengers to enter life rafts held close to the buoy, said buoy being provided with a plurality of inflatable life rafts together with compressed gas containers for inflating the life rafts, said rafts being contained in canisters releasably held on said buoy, said buoy including a mooring line normally stowed on a reel carried by the buoy but releasable therefrom after the buoy has been released from the vessel, said mooring line being capable of holding said plurality of life rafts in position relative to the buoy when the rafts are loaded with passengers, and wherein said life rafts have a combined capacity greatly in excess of the number of persons that can be carried by the buoy itself.

12. Lifesaving apparatus according to claim 11, wherein said buoy is provided with an engine driven propeller so as to be self-propelled.

13. Lifesaving apparatus according to claim 11, wherein said buoy body is filled with closed-pore foam plastics.

14. Lifesaving apparatus according to claim 11, wherein said life rafts have a capacity at least seven times that of the buoy.

15. Lifesaving apparatus for vessels comprising a buoy suitable for being carried by a vessel in a manner permitting easy launching of the buoy should the vessel sink, said buoy including a buoyant body and a cable reel rotatably mounted on the buoy and carrying a cable of adequate strength to act as an anchor cable, said cable being suitable for connection with the vessel so as to maintain connection between the floating buoy and the vessel after the vessel has sunk, said buoy including a deck area suitable for accommodating at least one crew member and several passengers, and also accommodating a plurality of inflatable life rafts together with pressurized gas containers for inflating the rafts, said rafts being contained in canisters releasably held on said deck, said buoy including a mooring line normally stowed on a reel carried by the buoy but releasable therefrom under the control of a crew member after the buoy has been released from the vessel, said mooring line being capable of holding said life rafts when inflated and floating on the water, and in which each side of said buoy is provided with two pulleys situated at opposite ends of the buoy, each pulley carrying a tag line having its upper end releasably secured to the deck of the buoy and its lower end attached to a weight, said upper ends of the tag lines being releasable from the deck and attachable to tethers connected to the vessel whereby when the buoy is along side the vessel the upper ends of the tag lines which are on the side of the buoy remote from the vessel may be detached from the deck of the buoy and attached to said tethers, whereupon the said weights tension the tag lines and the tethers in such manner as to hold the buoy against the side of the vessel.

16. Lifesaving apparatus for vessels, comprising a buoy suitable for being carried by a vessel in a manner permitting easy launching of the buoy should the vessel sink, said buoy including a buoyant body with a deck area suitable for accommodating crew members and several passengers, said buoy being provided with a plurality of inflatable life rafts together with compressed gas containers for inflating the life rafts, said rafts being contained in canisters releasably held on said buoy, said buoy including a mooring line normally stowed on a reel carried by the buoy but releasable thereform after the buoy has been released from the vessel, said mooring line being capable of holding said life rafts in position relative to the buoy, and said life rafts having a combined capacity greatly in excess of the number of persons that can be carried by the buoy itself, and in which each side of the buoy is provided with two pulleys situated at opposite ends of the buoy, each pulley carrying a tag line having its upper end releasably secured to the deck of the buoy and its lower end attached to a weight, said upper ends of the tag lines being releasable from the deck and attachable to tethers connected to the vessel whereby when the buoy is along side the vessel the upper ends of the tag lines which are on the side of the buoy remote from the vessel may be detached from the deck of the buoy and attached to said tethers, whereupon the said weights tension the tag lines and the tethers in such manner as to hold the buoy against the side of the vessel.

17. Lifesaving apparatus for vessels comprising, in combination, a buoy and mounting means for the buoy, said mounting means having a normal, retracted position in which the buoy is allowed to float off the vessel when sinking without interference by the mounting means and also having a launching position in which the mounting means can suspend the buoy and launch this over the side of the vessel, said buoy having means for holding the buoy close to the side of the vessel when launched, said buoy including a buoyant body with a configuration which provides a stable deck area suitable for accommodating crew members and several passengers, said buoy being provided with a plurality of inflatable life rafts together with compressed gas containers for inflating the life rafts, said rafts being contained in canisters releasably held on said buoy, said buoy including a mooring line normally stowed on a reel carried by the buoy but releasable therefrom after the buoy has been released from the vessel, said mooring line being capable of holding said plurality of life rafts in position relative to the buoy, and wherein said life rafts have a combined capacity greatly in excess of the number of persons that can be carried by the buoy itself.

18. Lifesaving apparatus according to claim 17, wherein said mounting means include means for suspending said buoy which means are mounted for swinging about a vertical axis from a position in which said means are capable of launching the buoy over the side of the vessel to a position in which they are clear of the vertical space above the buoy so as not to interfere with the buoy if this floats free from the vessel when sinking.

* * * * *